US007665653B2

(12) United States Patent
Fitzwater

(10) Patent No.: US 7,665,653 B2
(45) Date of Patent: Feb. 23, 2010

(54) TWISTED CARTON

(75) Inventor: Kelly R. Fitzwater, Lakewood, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 510 days.

(21) Appl. No.: 11/300,724

(22) Filed: Dec. 15, 2005

(65) Prior Publication Data

US 2007/0138242 A1 Jun. 21, 2007

(51) Int. Cl.
*B65D 25/34* (2006.01)
*B65D 5/00* (2006.01)

(52) U.S. Cl. ..... 229/116.1; 229/152

(58) Field of Classification Search ..... 229/116.1; D9/429, 432, 452
See application file for complete search history.

(56) References Cited

U.S. PATENT DOCUMENTS 3,912,156 A 10/1975 May
4,063,679 A * 12/1977 Henry ..... 229/108.1
5,350,110 A * 9/1994 Will ..... 229/125.15
5,848,749 A * 12/1998 Ljungstrom ..... 229/137
D426,154 S * 6/2000 de Baschmakoff ..... D9/432
6,364,199 B1 * 4/2002 Rose ..... 229/101

FOREIGN PATENT DOCUMENTS

FR 2.163.317 7/1973
GB 1 317 667 5/1973

* cited by examiner

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

A carton has a plurality of panel strips that extend around the periphery of the carton as well as along a length or height of the carton. The panel strips are defined by oblique fold lines extending along the height of the carton. The panel strips provide the carton with a rotated or "twisted" shape.

26 Claims, 7 Drawing Sheets

TWISTED CARTON

BACKGROUND

Cartons and other containers for housing articles such as food and beverages, consumer products, and other items are known. Conventional cartons typically have the shape of a parallelepiped, which may be limiting in commercial and/or other uses.

SUMMARY

The present invention generally relates to a carton having a plurality of panel strips that extend around at least a part of the periphery of the carton as well as along the height or length of the carton. In one embodiment, the panel strips are defined by strip fold lines extending obliquely along the height or length of the carton, so that the ends of the strip fold lines at the first end of the carton are offset on the carton periphery from the ends of the strip fold lines at the second end of the carton. According to at least one aspect of the present invention, the panel strips provide the carton with a rotated or "twisted" shape.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present invention generally relates to cartons having a "twisted" appearance. The cartons can contain, for example, articles such as food and/or consumer products. In this specification, the terms "top" and "bottom" are used to describe ends of the carton embodiments for clarity of description only, and are not intended to limit the scope of the invention.

Figure 1:
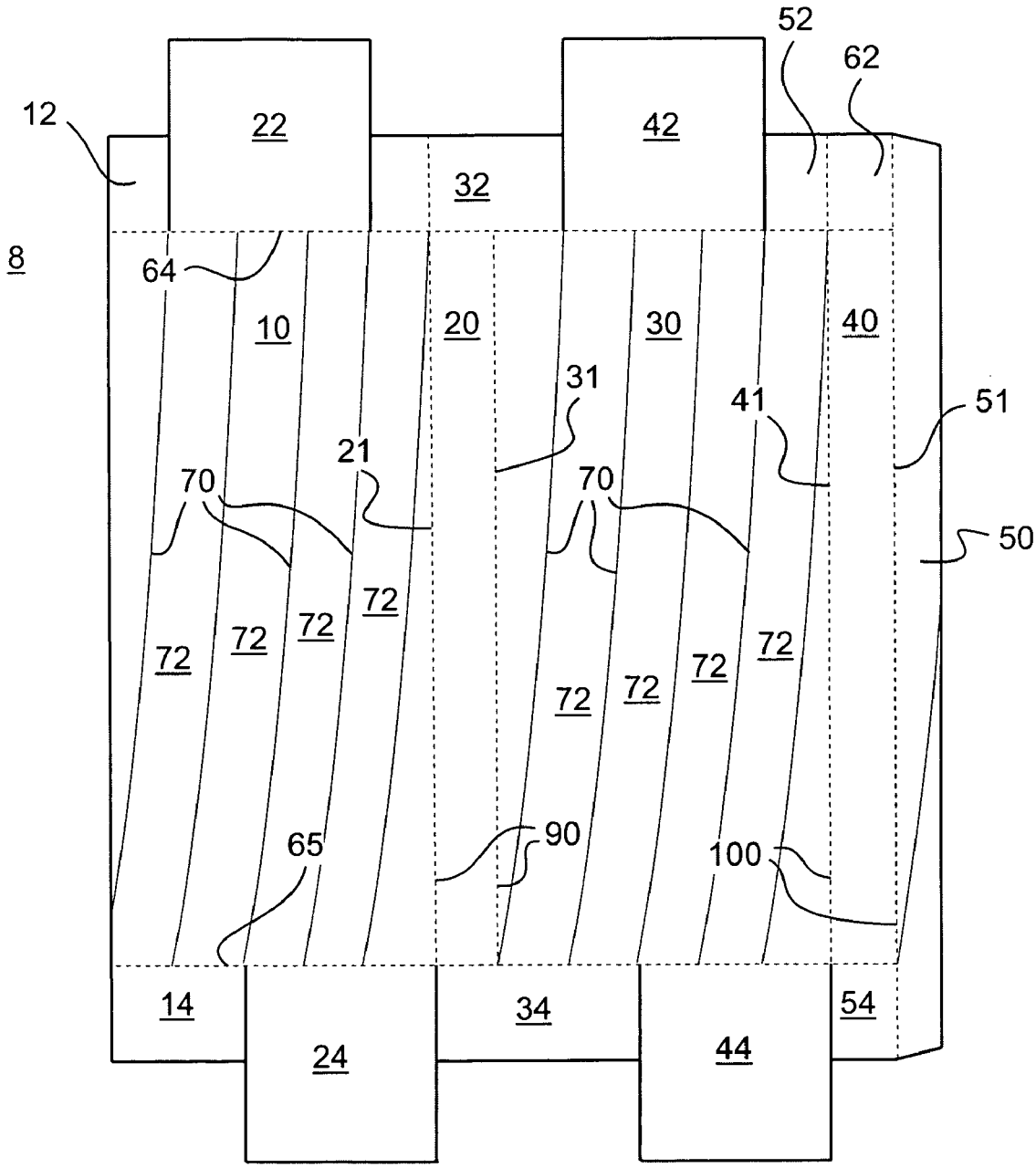
FIG. 1 is a plan view of a blank used to form a carton according to a first embodiment of the invention.

FIG. 1 is a plan view of a blank 8 used to form a carton 150 (illustrated in FIGS. 3 and 4) according to a first embodiment of the invention. The blank 8 can be considered to be divided into first, second, third, and fourth generally rectangular panels 10, 20, 30, 40, which are foldably connected at first, second, and third transverse fold lines 21, 31, 41. An adhesive panel or flap 50 can be foldably connected to the fourth panel 40 at a fourth transverse fold line 51.

First, second, third, fourth, fifth, and sixth top end flaps 12, 22, 32, 42, 52, 62 extend along a first or top marginal area of the blank 8, and may be foldably connected at a first longitudinally extending fold line 64 that extends along the length of the blank 8. First, second, third, fourth, and fifth bottom end flaps 14, 24, 34, 44, 54 extend along a second marginal area of the blank 8, and may be foldably connected at a second longitudinally extending fold line 65 that extends along the length of the blank 8. When the carton 150 is erected (FIGS. 3 and 4), the top end flaps 12, 22, 32, 42, 52, 62 close a top or first end of the carton 150, and the bottom end flaps 14, 24, 34, 44, 54 close a second or bottom end of the carton 150. The longitudinal fold lines 64, 65 may be substantially straight, or offset at one or more locations to account for blank thickness or for other factors, for example.

The blank 8 also comprises a plurality of strip fold lines 70 that extend generally from the first or top marginal area of the blank 8 to the second or bottom marginal area of the blank. As shown in FIG. 1, the strip fold lines 70 may extend from adjacent to including at the first longitudinal fold line 64, obliquely and curved or arcuately across the width of the blank 8, to points adjacent to including at the second longitudinal fold line 65. The strip fold lines 70 may be wholly or partially curved or arcuate and substantially parallel to one another, and may extend along a relative orientation that is generally oblique to the transverse fold lines 21, 31, 41. The strip fold lines 70 define obliquely extending curved or arcuate panel strips 72 within the first and third panels 10, 30. The panel strips 72 provide the twisted or rotated appearance in the erected carton 150 (FIGS. 3 and 4).

Figure 2:
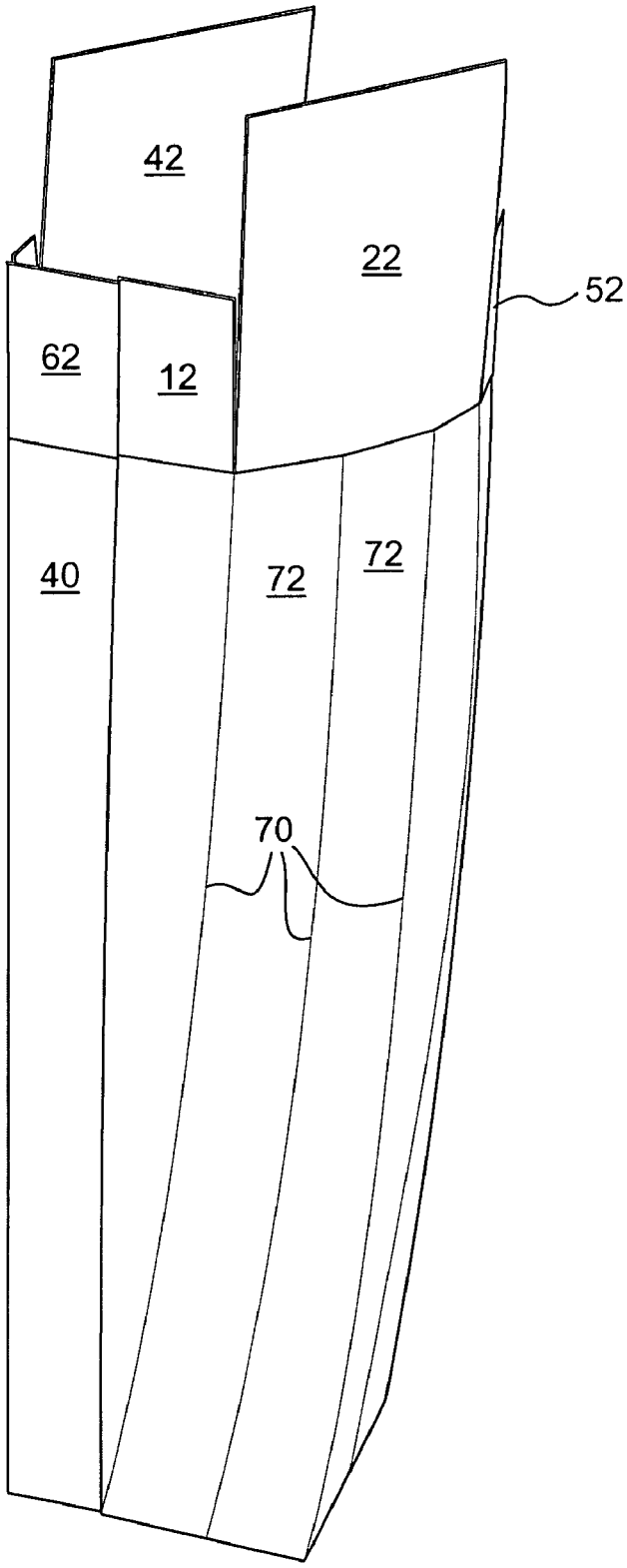
FIG. 2 illustrates the carton according to the first embodiment in a partially erected state.

FIG. 2 is a perspective view of the carton 150 in a partially erected state. The carton 150 is erected by gluing or otherwise adhering the adhesive flap 50 (shown in FIG. 1) to the first panel 10 so that the panels 10, 20, 30, 40 may be opened to form a generally tubular sleeve. The ends of the tubular sleeve may then be closed by folding and gluing or otherwise adhering the top end flaps 12, 22, 32, 42, 52, 62 and the bottom end flaps 14, 24, 34, 44, 54 (not shown in FIG. 2).

Figure 3:
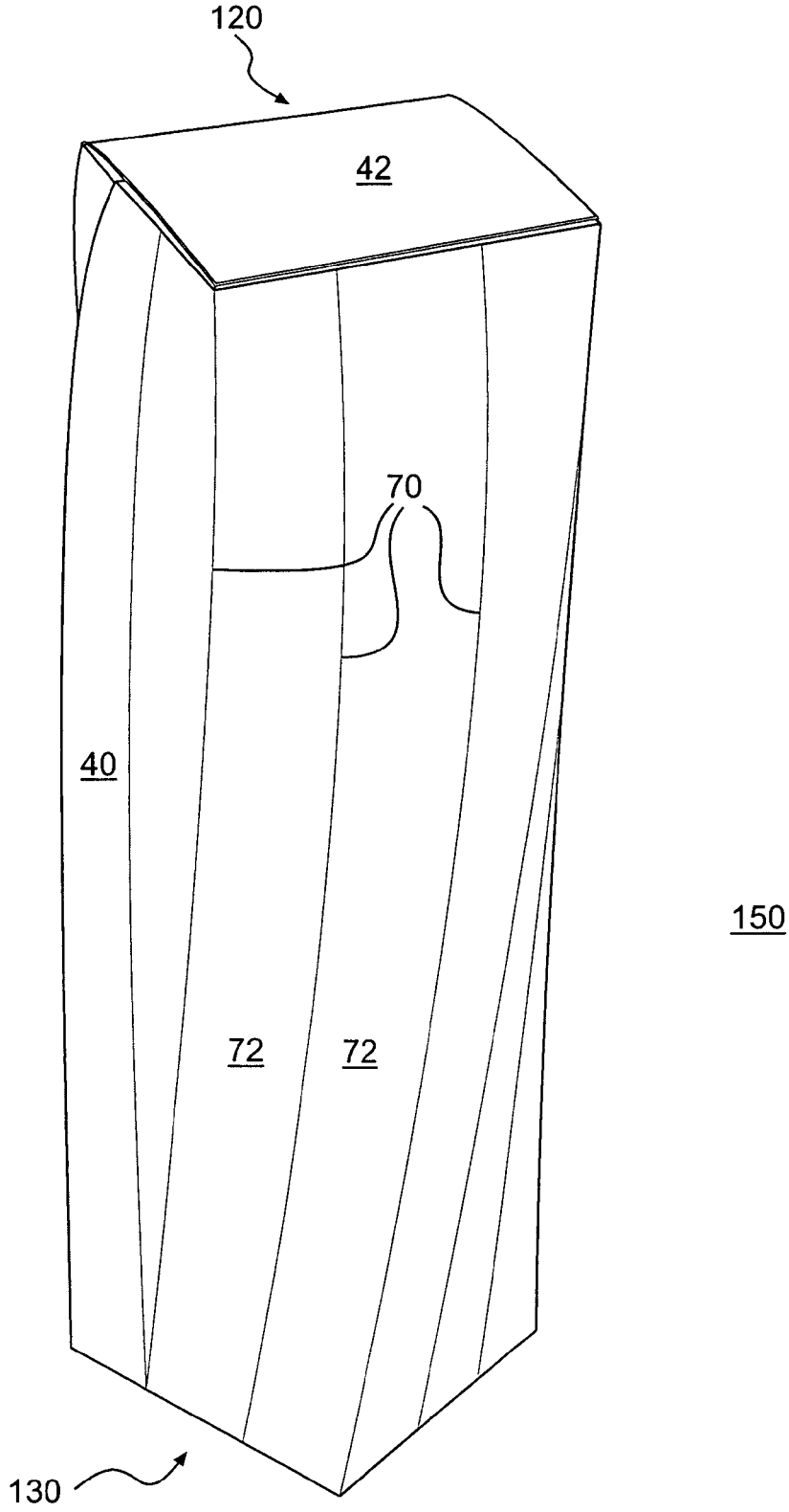
FIG. 3 is a perspective view of the erected carton according to the first embodiment.
Figure 4:
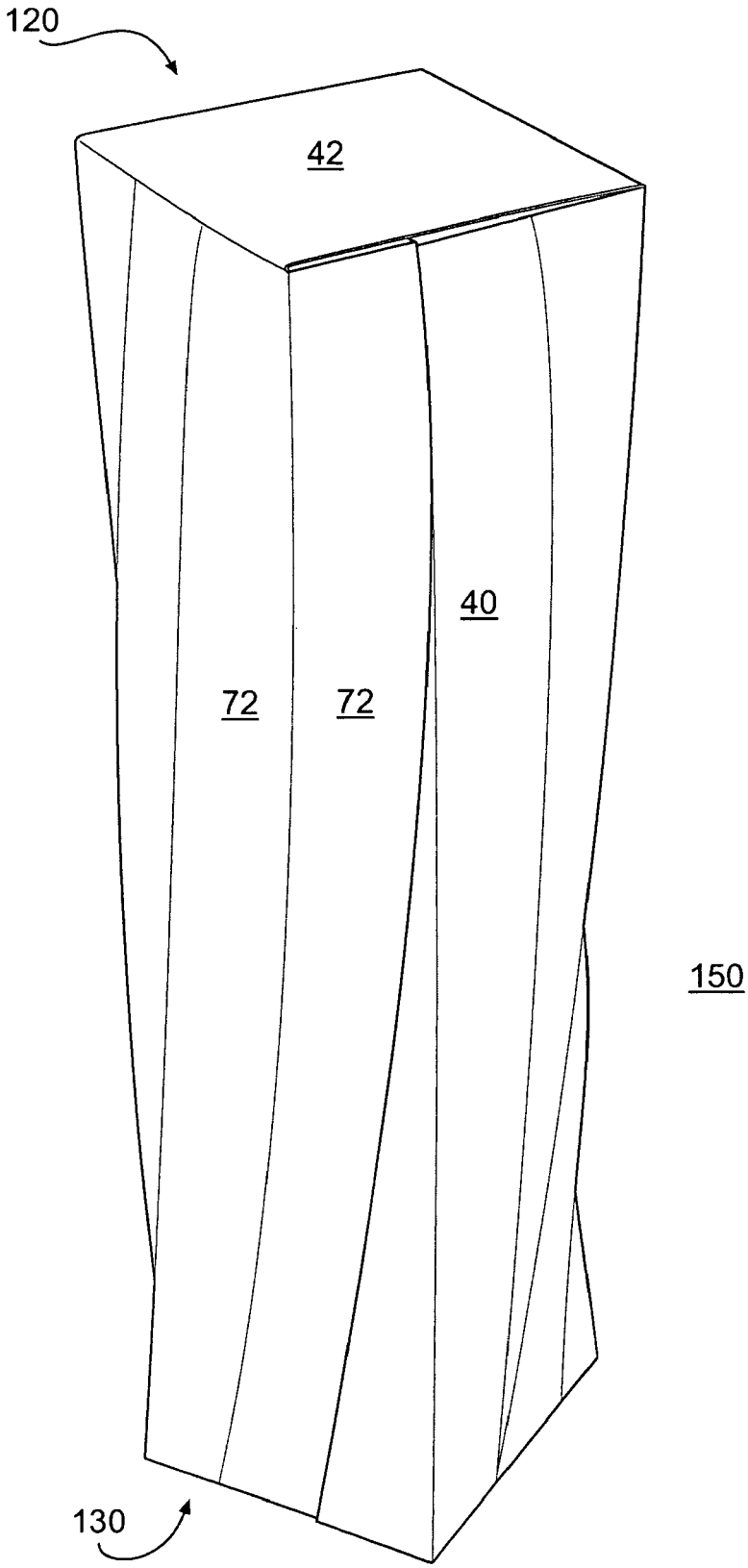
FIG. 4 is another perspective view of the carton according to the first embodiment.
Figure 5:
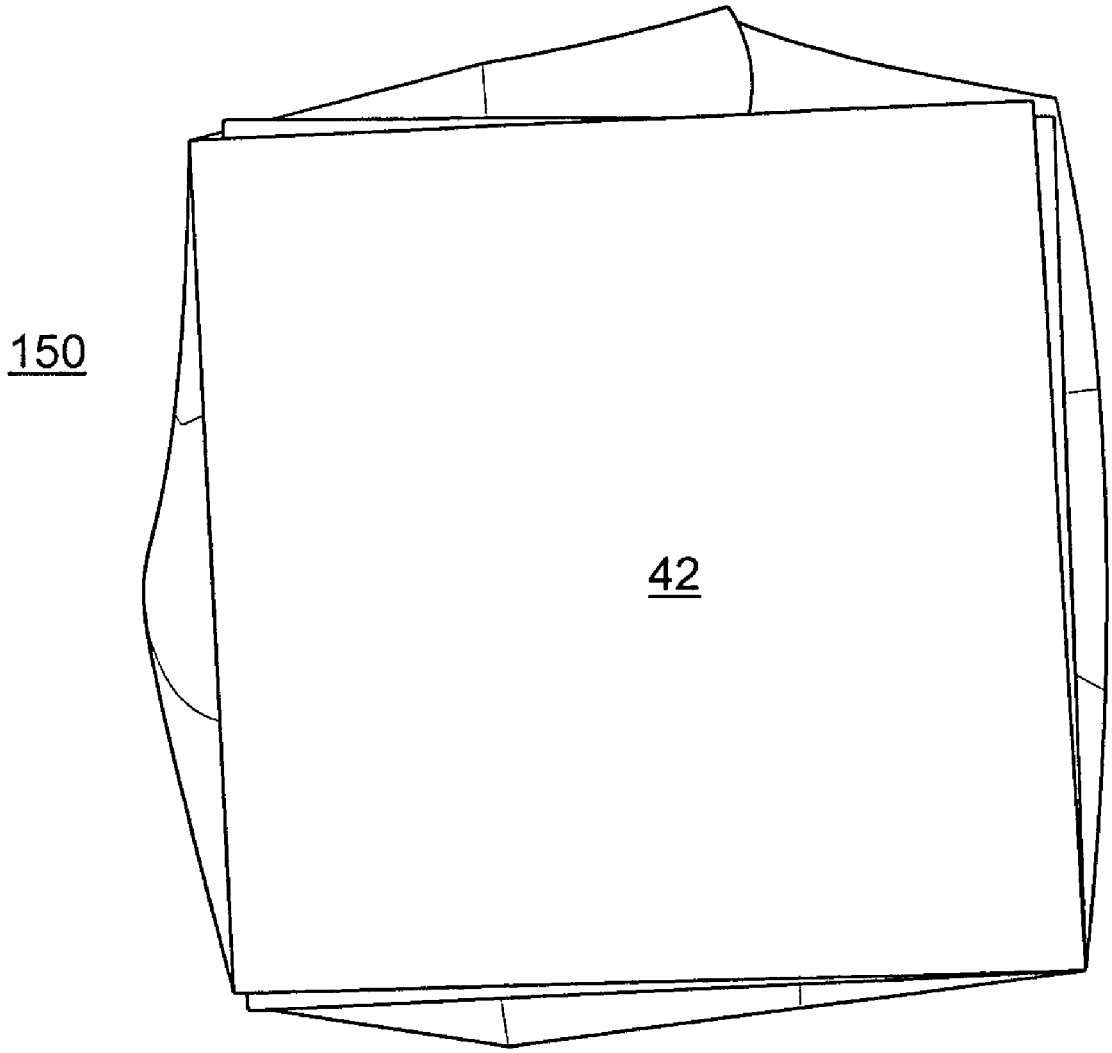
FIG. 5 is an end view of the carton according to the first embodiment.

FIGS. 3 and 4 illustrate the erected carton 150 with both ends closed. In FIGS. 3 and 4, the bottom end flaps 14, 24, 34, 44, 54 are adhered together to form a second or bottom end panel 130, and the top end flaps 12, 22, 32, 42, 52, 62 are adhered together to form a first or top end panel 120. Articles may be loaded into the sleeve in a conventional manner at any time before one or both ends of the carton are closed by the end flaps. The end panels 120, 130 may be, for example, generally rectangular. As shown in FIG. 3, the orientation of the top end panel 120 is rotated with respect to the bottom end panel 130 due to the twisting of the carton 150 caused by the strip fold lines 70. FIG. 5 is a top end view of the carton 150 illustrating the top end panel 120.

Figure 6:
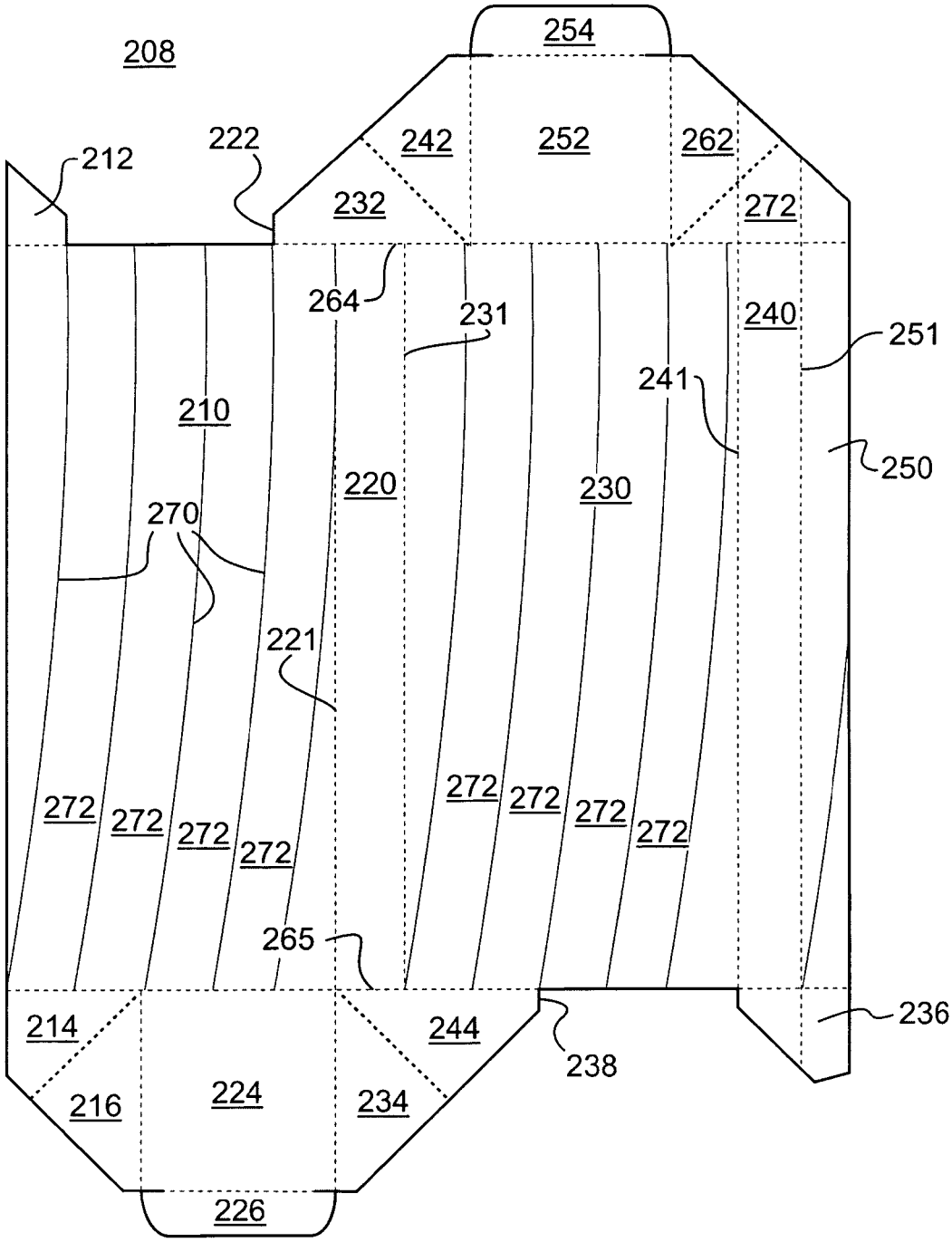
FIG. 6 is a plan view of a blank used to form a carton according to a second embodiment of the invention.

FIG. 6 is a plan view of a blank 208 used to form a carton 350 (illustrated in FIGS. 7 and 8) according to a second embodiment of the invention. The blank 208 can be considered to be divided into first, second, third, and fourth generally rectangular panels 210, 220, 230, 240, which are foldably connected at first, second, and third transverse fold lines 221, 231, 241. An adhesive panel or flap 250 can be foldably connected to the fourth panel 240 at a fourth transverse fold line 251.

A first or top major end flap 252 is foldably connected to the third panel 230. A pair of first proximal tuck-in gusset panels 242, 262 are foldably connected to opposite ends of the first major end flap 252, and a pair of first distal tuck-in gusset panels 232, 272 are foldably connected to the first proximal gusset panels 242, 262, respectively. The gusset panel 232 is foldably connected to the panels 210, 220, 230, and the gusset panel 272 is foldably connected to the panels 230, 240, 250. A first closing flap 254 may be foldably connected to a distal end of the first major end flap 252.

A second or bottom major end flap 224 is foldably connected to the first panel 210. A pair of second proximal tuck-in gusset panels 216, 234 is foldably connected to opposite ends of the second major end flap 224, and a pair of second distal tuck-in gusset panels 214, 244 is foldably connected to the proximal gusset panels 216, 234, respectively. The gusset panel 214 is foldably connected to the first panel 210, and the gusset panel 244 is foldably connected to the panels 220, 230. A second closing flap 226 may be foldably connected to a distal end of the second major end flap 224.

Figure 7:
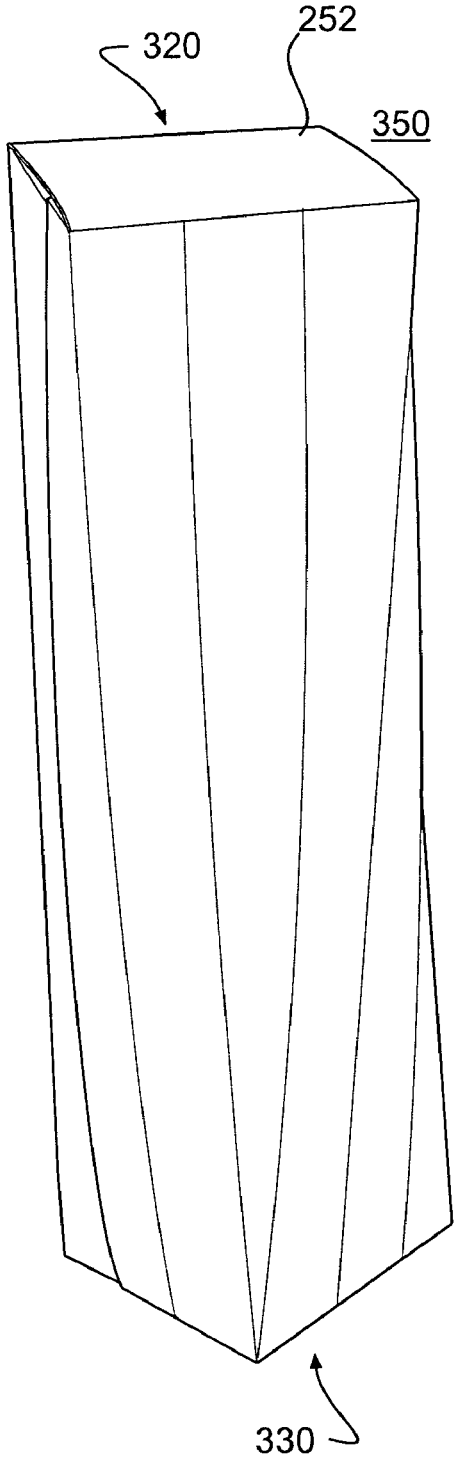
FIG. 7 is a perspective view of the carton according to the second embodiment.
Figure 8:
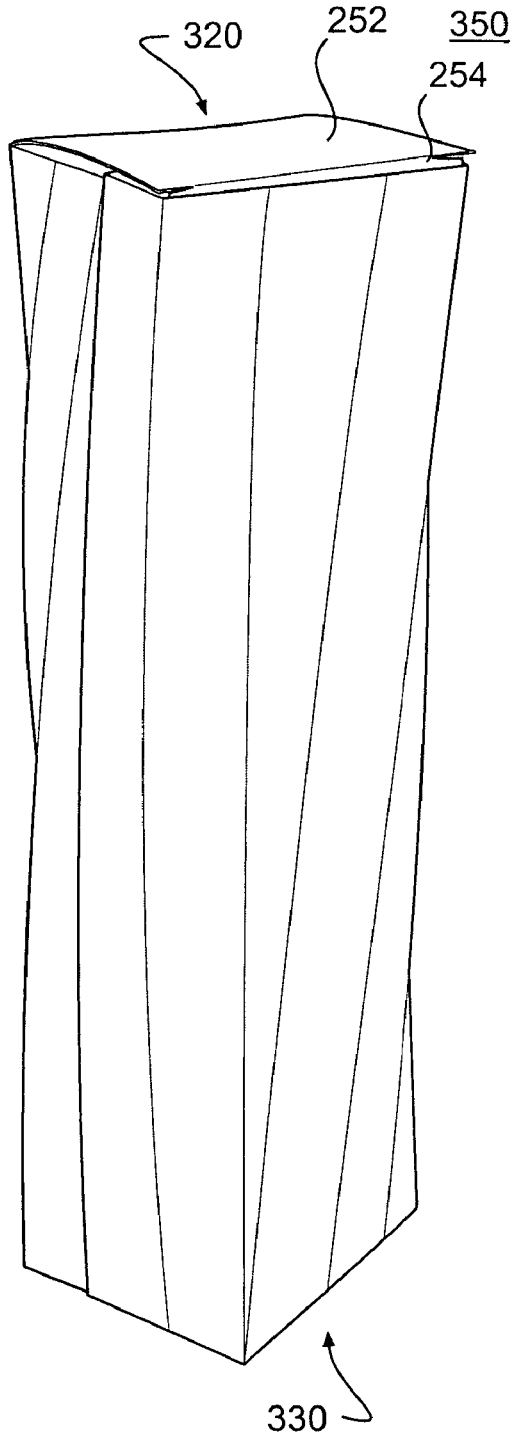
FIG. 8 is another perspective view of the carton according to the second embodiment.

A first or top securing flap 212 may be foldably connected to the first panel 210, and disposed opposite to the distal tuck-in gusset 232. The gusset panel 232 and the first securing flap 212, along with an edge of the first panel 210, define a first securing recess 222 into which the first closing flap 254 is inserted in the erected carton 350 (FIGS. 7 and 8). A second securing flap 236 may be foldably connected to the panels 240, 250, and disposed opposite to the distal tuck-in gusset panel 244. The gusset panel 244 and the second securing flap 236, along with an edge of the third panel 230, define a second securing recess 238 into which the second closing flap 226 is inserted in the erected carton 350.

The flaps 212, 252 and the gusset panels 232, 242, 262, 272 extend along a first or top marginal area of the blank 208, and may be foldably connected at a first longitudinal fold line 264 that extends along the length of the blank 208. The flaps 224, 236 and the gusset panels 214, 216, 234, 244 extend along a second or bottom marginal area of the blank 208, and may be foldably connected at a second longitudinal fold line 265 that extends along the length of the blank 208. The longitudinal fold lines 264, 265 may be substantially straight, or offset at one or more locations to account for blank thickness or for other factors, for example.

The blank 8 also comprises a plurality of strip fold lines 270 that extend generally from the first or top marginal area of the blank 208 to the second or bottom marginal area of the blank 8. The strip fold lines 270 may be, for example, wholly or partially curved or arcuate and substantially parallel to one another, and may extend along a relative orientation that is generally oblique to the transversely extending fold lines 221, 231, 241. The strip fold lines 270 define obliquely extending curved panel strips 272 within the first and third panels 210, 230, the panel strips 272 providing the rotated or twisted appearance in the erected carton 350 (FIGS. 7 and 8). As shown in FIG. 6, the strip fold lines 270 may extend from adjacent to including at the first longitudinal fold line 264 to points adjacent to including at the second longitudinal fold line 265.

Referring to FIGS. 6-8, the blank 208 can be closed to a tubular form by adhering the adhesive flap 250 to the first panel 210. The gusset panel pairs 232, 242 and 272, 262 may then be tucked inwardly to cause the first or top major end flap 252 to fold inwardly about the first longitudinal fold line 264. The first securing flap 212 may also be folded inwardly about the fold line 264 to define the first securing recess 222. The first closing flap 254 may then be inserted into the first securing recess 222 to form a first or top end panel 320 of the erected carton 350. Similarly, the gusset panel pairs 214, 216 and 244, 234 may be tucked inwardly to cause the second major end flap 224 to fold inwardly about the second longitudinal fold line 265. The second securing flap 236 may also be folded inwardly about the fold line 265 to define the second securing recess 238. The second closing flap 224 may then be inserted into the second securing recess 238 to form a second or bottom end panel 330 of the erected carton 350. When the carton 350 is erected, the top and bottom gusseted major end flaps 252, 224 provide for selectively recloseable first and second or top and bottom ends of the carton.

The first and second end panels 320, 330 may be closed by, for example, adhesives or other means. Alternatively, the interaction of the gusseted closing flaps with the securing recesses may be sufficient to maintain the end panels 320, 330 in a closed state. In such an embodiment, the top and bottom panels can be selectively opened and reclosed. Articles may be loaded into the carton in a conventional manner at any time before one or both ends of the carton 350 are closed.

As shown in FIGS. 3, 5, 7 and 8, the ends of the strip fold lines at the first end of a carton are offset on the carton periphery from the ends of the same respective strip fold lines at the second end of the carton. The strip fold lines therefore appear to twist or rotate around the periphery of the carton as they extend along the length or height of the carton. The panel strips defined by the strip fold lines accordingly provide the cartons with a rotated or twisted shape.

EXAMPLE 1

A carton as illustrated in FIGS. 3-4 was constructed from solid unbleached sulfate (SUS) board, .016 caliper. The carton had a height or length of about 9.8 inches, and the panel strips had a width of about 0.7 inches. The major end flaps had a width of about 2.5 inches and a length of about 2.7 inches. The strip fold lines forming the panel strips were formed from creases.

In the above embodiments, the strip fold lines defining the panel strips are illustrated as having a slight curved profile along most or all of their lengths. The strip fold lines can alternatively, however, be straight or at least substantially straight lines that extend obliquely to the transverse fold lines defining the first, second and third panels. In this embodiment, the panel strips formed from the substantially straight strip fold lines will generally have the shape of parallelograms with non-orthogonal corners. The strip folds lines may also comprise combinations of straight and curved sections.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks. In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the dispensers to function at least generally as described above. The blanks can also be laminated to or coated with one or more sheet-like materials at selected panels or panel sections.

In accordance with the exemplary embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

The above embodiments may be described as having one or panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A blank for forming a carton, comprising:

a first panel;

a second panel foldably connected to the first panel at a first transverse fold line;

a third panel foldably connected to the second panel at a second transverse fold line;

at least one first end flap extending along a first marginal area of the blank and foldably attached to at least one of the first, second, and third panels along a first longitudinally extending fold line extending parallel to a longitudinal axis of the blank;

at least one second end flap extending along a second marginal area of the blank and foldably attached to at least one of the first, second, and third panels along a second longitudinally extending fold line extending parallel to a longitudinal axis of the blank; and a plurality of strip fold lines extending across each of the first and third panels between the first longitudinally extending fold line and the second longitudinally extending fold line, the plurality of strip fold lines being oblique relative to the first and second transverse fold lines and defining a plurality of panel strips, wherein the second panel is arranged between the first panel and the third panel, and the second panel is substantially free of strip fold lines, each of the first and second transverse fold lines extending in a transverse direction of the blank that is perpendicular to a longitudinal axis of the blank.

2. The blank of claim 1, wherein the strip fold lines are curved along a majority of their lengths.

3. The blank of claim 1, wherein the first, second and third panels are substantially rectangular.

4. The blank of claim 3, further comprising a fourth panel foldably connected to the third panel at a third transverse fold line.

5. The blank of claim 4, wherein the third fold line extends in a transverse direction of the blank.

6. The blank of claim 1, further comprising: at least one first rectangular end flap extending along a first marginal area of the blank; and at least one second rectangular end flap extending along a second marginal area of the blank, the first rectangular end flap having first orthogonal edges and the second rectangular end flap having second orthogonal edges, the first and second rectangular end flaps being for closing a respective first and second end of the carton formed from the blank, the first orthogonal edges are for being out of registration with the second orthogonal edges when the carton is formed from the blank.

7. The blank of claim 1, wherein the strip fold lines are substantially straight along a majority of their lengths.

8. In combination, a carton formed from the blank of claim 1 and a plurality of articles enclosed within the carton.

9. A blank for forming a carton, comprising:

a first rectangular panel;

a second rectangular panel foldably connected to the first panel at a first transverse fold line;

a third rectangular panel foldably connected to the second panel at a second transverse fold line;

a fourth rectangular panel foldably connected to the third panel at a third transverse fold line;

at least one first end flap extending along a first marginal area of the blank and foldably attached to at least one of the first, second and third panels along a first longitudinally extending fold line extending parallel to a longitudinal axis of the blank;

each of the first, second, and third transverse fold lines extending in a transverse direction of the blank that is perpendicular to a longitudinal axis of the blank;

at least one second end flap extending along a second marginal area of the blank and foldably attached to at least one of the first, second, and third panels along a second longitudinally extending fold line extending parallel to a longitudinal axis of the blank; and a plurality of strip fold lines extending across each of the first and third panels between the first longitudinally extending fold line and the second longitudinally extending fold line, wherein the plurality of strip fold lines being oblique relative to the first, second, and third transverse fold lines and define a plurality of panel strips, and the second and fourth panels being substantially free of strip fold lines.

10. The blank of claim 9, wherein the strip fold lines are curved along a majority of their lengths.

11. The blank of claim 9, wherein the strip fold lines are straight along a majority of their lengths.

12. A carton having a first end and a second end, comprising:

a first rectangular panel;

a second rectangular panel adjacent and foldably connected to the first panel at a first transverse fold line;

a third rectangular panel adjacent and foldably connected to the second panel at a second transverse fold line; and a fourth rectangular panel foldably connected to the third panel at a third transverse fold line, wherein a plurality of strip fold lines extend obliquely across each of the first and third panels and define a plurality of panel strips, the plurality of strip fold lines being oblique relative to the first and second transverse fold lines, the panel strips extending along a length of the carton between the first and second ends, wherein the first end is defined by a plurality of orthogonal first edges, the second end is defined by a corresponding plurality of orthogonal second edges, and the first edges are rotated with respect to the second edges so that the plurality of first edges are out of registration with the plurality of second edges, the second panel is arranged between the first and third panels and the second panel is substantially free of strip fold lines.

13. The carton of claim 12, wherein the strip fold lines are curved along a majority of their lengths.

14. The carton of claim 12, wherein the strip fold lines are straight along a majority of their lengths.

15. The carton of claim 12, further comprising: a first end panel at the first end of the carton; and a second end panel at the second end of the carton, the first end and the second end being substantially closed by the first end panel and the second end panel, respectively.

16. The carton of claim 15, wherein the plurality of strip fold lines comprises a first strip fold line, the first strip fold line having a first end and a second end, the first end of the first strip fold line being located adjacent to one of the plurality of first edges at the first end of the carton, and the second end of the first strip fold line being located adjacent to one of the plurality of second edges at the second end of the carton, wherein the first end of the first strip fold line is offset on the periphery of the carton with respect to the second end of the first strip fold line.

17. The carton of claim 15, wherein the first end panel is a rectangular end panel and the first end is a rectangular end, and the second end panel is a rectangular end panel and the second end is a rectangular end.

18. The carton of claim 15, wherein the strip fold lines extend from adjacent to the first end panel to adjacent to the second end panel.

19. The carton of claim 12, wherein the strip fold lines extend around at least a part of a periphery of the carton and along the length of the carton.

20. The carton of claim 19, wherein the strip fold lines extend from adjacent to the first end to adjacent to the second end.

21. A carton having a first end and a second end, comprising:

a first rectangular panel;

a second rectangular panel foldably connected to the first panel at a first transverse fold line;

a third rectangular panel foldably connected to the second panel at a second transverse fold line; and a plurality of panel strips in each of the first and third panels extending between the first and second ends of the carton, the panel strips being defined by a plurality of strip fold lines in each of the first and third panels, the plurality of strip fold lines being oblique relative to the first and second transverse fold lines, wherein the strip fold lines twist around at least a part of a periphery of the carton and along a length of the carton, wherein the first end is defined by a plurality of orthogonal first edges, the second end is defined by a corresponding plurality of orthogonal second edges, and the first edges are rotated with respect to the second edges so that the plurality of first edges are out of registration with the plurality of second edges, wherein the second panel is arranged between the first panel and the third panel, and the second panel is substantially free of strip fold lines.

22. The carton of claim 21, further comprising: a first end panel at the first end of the carton; and a second end panel at the second end of the carton.

23. The carton of claim 22, wherein the strip fold lines extend from adjacent to the first end panel to adjacent to the second end panel.

24. The carton of claim 23, wherein the plurality of strip fold lines comprises a first strip fold line, the first strip fold line having a first end and a second end, the first end of the first strip fold line being located adjacent to one of the plurality of first edges at the first end of the carton, and the second end of the first strip fold line being located adjacent to one of the plurality of second edges at the second end of the carton.

25. The carton of claim 24, wherein the first end of the first strip fold line is offset on the periphery of the carton with respect to the second end of the first strip fold line.

26. The carton of claim 21, wherein the carton is constructed from paperboard.

* * * * *